US007392866B2

(12) United States Patent
Brady

(10) Patent No.: US 7,392,866 B2
(45) Date of Patent: Jul. 1, 2008

(54) ROOF DRILLING SYSTEM IMPROVEMENTS

(75) Inventor: William J. Brady, St. Louis, MO (US)

(73) Assignee: The William Brady Loving Trust, Creve Coeur, MO (US)

( * ) Notice: Subject to any disclaimer, the term of this patent is extended or adjusted under 35 U.S.C. 154(b) by 0 days.

(21) Appl. No.: 11/553,063

(22) Filed: Oct. 26, 2006

(65) Prior Publication Data

US 2007/0119625 A1 May 31, 2007

Related U.S. Application Data

(63) Continuation-in-part of application No. 11/289,683, filed on Nov. 29, 2005.

(51) Int. Cl.
*E21B 10/54* (2006.01)
*E21B 10/567* (2006.01)

(52) U.S. Cl. ..... 175/427; 175/425; 175/421; 405/259.1

(58) Field of Classification Search ..... 175/57, 175/415, 385, 340, 397, 421, 425, 427, 406; 405/259.1
See application file for complete search history.

(56) References Cited

U.S. PATENT DOCUMENTS 3,163,246 A 12/1964 Vagins
5,180,022 A 1/1993 Brady
D340,248 S 10/1993 Brady
5,303,787 A 4/1994 Brady
D351,174 S 10/1994 Brady
5,383,526 A 1/1995 Brady
5,429,199 A 7/1995 Sheirer
5,988,301 A 11/1999 Lundell
6,044,920 A 4/2000 Massa
D424,579 S 5/2000 Brady
6,092,612 A 7/2000 Brady
D430,578 S 9/2000 Brady
6,161,635 A 12/2000 Brady
6,374,932 B1 4/2002 Brady
D514,131 S 1/2006 Brady
2007/0119624 A1* 5/2007 Brady ..... 175/57

* cited by examiner

*Primary Examiner*—Kenneth Thompson
(74) *Attorney, Agent, or Firm*—Holland & Hart

(57) ABSTRACT

The invention is embodied in a heavy duty drill bit for hard/soft rock drilling comprising a high fatigue-resistant, high alloy steel bit body having a PCD cutter member and an enlarged shank portion constructed to accommodate torsional forces at high thrust pressures, and reamer means for compensating the effect of bore hole rifling. The invention further involves the method of forming a roof bolting matrix in extremely hard rock formations having a compression strength up to about 50,000 psi using PCD wafers on a high tensile strength steel body coupled by a heavy duty shank through high fatigue-resistant reamer means to a high strength drive steel member.

20 Claims, 7 Drawing Sheets

ROOF DRILLING SYSTEM IMPROVEMENTS

CROSS-REFERENCE TO RELATED APPLICATION

This is a continuation in part of U.S. application Ser. No. 11/289,683 filed Nov. 29, 2005 for Roof Drilling Improvements, the entire disclosure of which is incorporated herein by reference.

BACKGROUND OF THE INVENTION

1. Field of the Invention

The invention relates generally to improvements in roof drilling systems used in the industry, mining and construction fields.

2. Description of the Prior Art

Polycrystalline diamond (PCD) has become widely used in making cutting tool inserts. PCD materials are formed of fine diamond powder sintered by intercrystalline synthesis technology into a predetermined layer or shape; and such PCD layers are usually bonded to a substrate of "precemented" tungsten carbide to form a polycrystalline diamond compact (PDC) or insert (e.g. cutting element). The term "high density ceramic" (HDC) is sometimes used to refer to a mining tool having an insert with a PCD layer. The term "chemical vapor deposition" (CVD) is a form of pure PCD used for inserts, and "thermally stable product" (TSP) is another form of pure diamond that can be bonded to a carbide substrate or directly to a steel bit body using new vacuum furnace techniques by GE and Sandia Laboratories. Still other superhard surfacing and layered materials, such as "advanced diamond composite (ADC)" and "nitride" compositions of titanium (TiN) and carbon ($C_2N_2$), are gaining acceptance in the mining field. All such superabrasive or superhard materials—PCD, TSP, CVD, ADC and nitride compositions are applicable to the present invention, and the terms "PCD" and "PCD" shall be considered inclusive of all.

Drag bits are one class of drill bits used in rotary drilling operations. Drag bits have PCD or like cutting elements which act to cut or shear the earth material. The action of some flushing medium (fluid drilling mud, water, a compressed air or vacuum system) is important in all types of drilling operations to cool the cutting elements and to flush or transport cuttings away from the cutting site to prevent accumulation of debris. The cooling action is particularly important in the use of PCD cutters to prevent carbon transformation of the diamond material at about 1250° F.

The prior art is replete with various cutting element designs directed by a desire to form structurally stronger, tougher and more wear-resistant and fracture-resistant tools. It is well-known for example, that superabrasive (PCD) cutting elements can fail caused by the fact that the materials comprising the superabrasive portion, or diamond table, and the substrate have different coefficients of thermal expansion, elastic moduli and bulk compressibilities. Thus the table and substrate materials of a PCD wafer shrink at different rates during cooling after formation and the diamond table tends to be in residually stressed tension while the substrate material tends to be in residually stressed compression when subjected to cutting loads during drilling operations which may result in fracturing of the cutting element. My prior U.S. Pat. No. 6,374,932 addressed these heat management problems.

My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerated the speed of drilling action as well as substantially reduced bit breakage and change-over downtime. These prior HCD non-coring drill bits are capable of drilling over 100-300 holes of 4 foot depth for a roof bolting matrix with a single bit and in shorter times with less thrust than the standard carbide bits in certain hard rock or sandstone formations of 22,000-28,000 psi compressive strength. Although these prior HCD bits drilled through such earth structures, it was discovered that some drill bits might plug in drilling through mud seams and other soft shale or broken earth formations and PCD cutting inserts may even shatter in working through stratus of extremely hard or fractured earth conditions. My U.S. Pat. No. 5,535,839 discloses another HCD roof drill bit designed to operate more efficiently in broken and muddy earth formations. It should be noted that in some metal/non-metal mining, and particularly in tunnel construction there is frequently extremely hard rock formations in the compressive strength range of 25,000 to 50,000 together with seams of other mud, shale and the like. My prior PCD bits are capable of achieving some success in these conditions, but drilling speeds are slow and fracturing of drill steel, couplers and drill bits frequently occurs.

SUMMARY OF THE INVENTION

The invention is embodied in a heavy duty hard rock drill tool comprising a high fatigue-resistant high NiCr alloy steel bit body having a working head portion with circular PCD cutter inserts, and an enlarged shank portion constructed and arranged to obviate breakage from torsion forces exerted on the tool during drilling operations in earth formations including, hard rock structures with a compressive strength as high 50,000 psi, and non-PCD reamer/coupler means to compensate for bore hole rifling. The invention further involves the method of forming a roof bolting matrix in hard/soft rock formations using PCD wafers on a high alloy steel body having a heavy duty shank mounting means or connector.

It is the principal object of the present invention to provide a hard rock boring tool with an improved heavy duty high alloy steel body and mounting shank that will extend the useful life of the tool.

Another object is to provide a method for producing clean bore holes in a roof bolting matrix.

Another object is to provide a method for producing clean bore holes in a roof bolting matrix.

Still another object is to provide a method for obviating premature tool failure in hard/soft rock drilling.

Still another object is to provide a method for operating super hard surfaced cutter elements on a heavy duty high alloy steel body permitting drilling at optimum speed and thrust in hard/soft rock structures.

Still another object is to provide an HCD bit using PCD cutting elements and an optimum supporting body, which accommodates torsional stress, and drills faster in extremely hard/soft rock structures.

Other objects and features will become more apparent hereinafter.

BRIEF DESCRIPTION OF THE DRAWINGS

In the accompanying drawings which form a part of this specification, and wherein like numerals refer to like parts wherever they occur.

BRIEF DESCRIPTION OF THE PREFERRED EMBODIMENTS

The present invention relates to improvements in rotary drag bits, particularly roof drill bits for boring and drilling operations in metal/non-metal mining and construction, and to methods for carrying out such metal/non-metal mining operations. The following definitions will be useful for a fuller understanding of the scope of the invention disclosed:

"Metal/non-metal mine" or "metal/non-metal mining" is used herein as a generic or comprehensive term to mean any type of underground mine or tunnel and encompasses ore mining, hard rock mining, coal mining operations, and construction tunneling and excavation.

"High-fatigue resistant" and/or "high alloy" are used herein with reference to the material strength of steel having a tensile strength in the range of 175,000 to 225,000 psi (typically 209,500 to 210,000 for 4340 steel) and a fatigue yield strength in the range of 135,000 to 145,000 psi (typically 141,000 psi for 4340 steel).

"Hard/soft rock" is used to designate earth formations that are extremely difficult to bore, as found in metal/non-metal mines, and include dense rock structures with compressive strength up to 50,000 psi.

"Coring/non-coring" is used herein with reference to the boring action of the drill tool to define a cutter element placement tending to leave a center or axially disposed uncut core of hard/soft rock or mineral material (in a coring sense), but which is broken out by further drilling action of the tool (in a non-coring sense).

"Heavy duty" is used with reference to any drill tool that has a connecting shank of proportionately larger dimension as contrasted with prior drill tools with ½ inch or smaller shanks.

"Multitude" or "multitudinous" is used with reference to the drilling of roof bore holes or the like to indicate an extremely extensive number of holes and/or amount of drilling length (depth) far in excess of a scant few such holes or short length drilling capability of the prior art.

Figure 1:
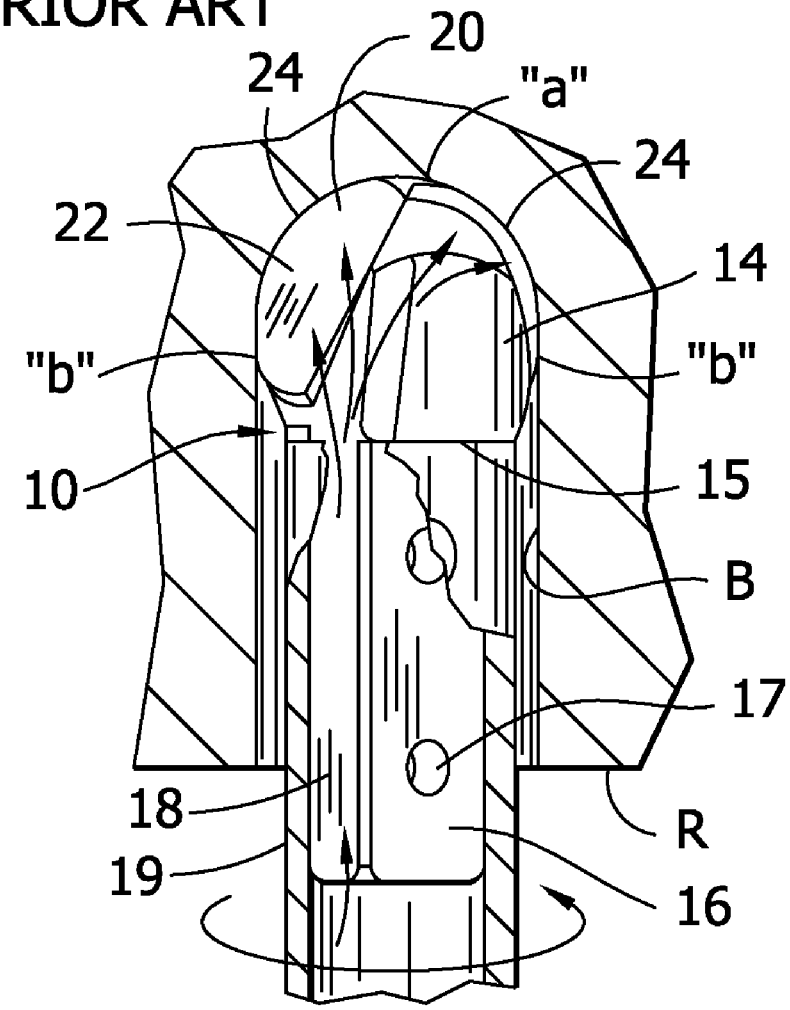
FIG. 1 PRIOR ART
FIG. 1 is a side elevational view, partly broken away, showing a prior art embodiment of an earlier rotary drill bit.

FIG. 1 shows one embodiment of my earlier non-coring roof drill bit as taught by my U.S. Pat. Nos. 5,180,022; 5,303,787 and 5,383,526 the disclosures of which are incorporated by reference. Briefly stated, this non-coring roof drill bit 10 has a steel head portion 14 and shank portion 16 that is typically seated, at 15, on the end of a drive steel 19 of a drilling machine, such as a New Fletcher double boom roof bolter machine (not shown). The shank 16 and drive steel 19 have a complementary sliding fit and are cross-pinned together, as through bolt holes 17, for co-rotational movement. The shank 16 has vertical water flutes or flumes 18 formed on opposite sides for channeling flushing fluids used for cooling and cleaning the cutter inserts 20 of the drill bit 10. These cutter inserts 20 are formed from a PCD disc cut into two semi-round halves and bonded to a substrate of tungsten carbide to form PDC wafers that are then brazed to oppositely facing surfaces of the head portion 14. The wear faces 22 of these inserts 20 both face in the direction of rotation and are positioned at negative rake and skew angles so that the PCD cutter edges 24 perform a slicing action in cutting hard rock or other earthen formations. The effective cutting arc of each insert is about 120° extending from beyond high entry point "a" adjacent to the exis past the gauge cutting outer margin at point "b". The insert 10 is non-coring since the cutter edges of the inserts 20 come substantially together at the axis of the drill bit to define an essentially continuous sinusoidal or S-shaped cutting arc across the diameter of the drill bit tool. This drill bit embodiment is shown drilling bore B in roof top R.

Figure 2:
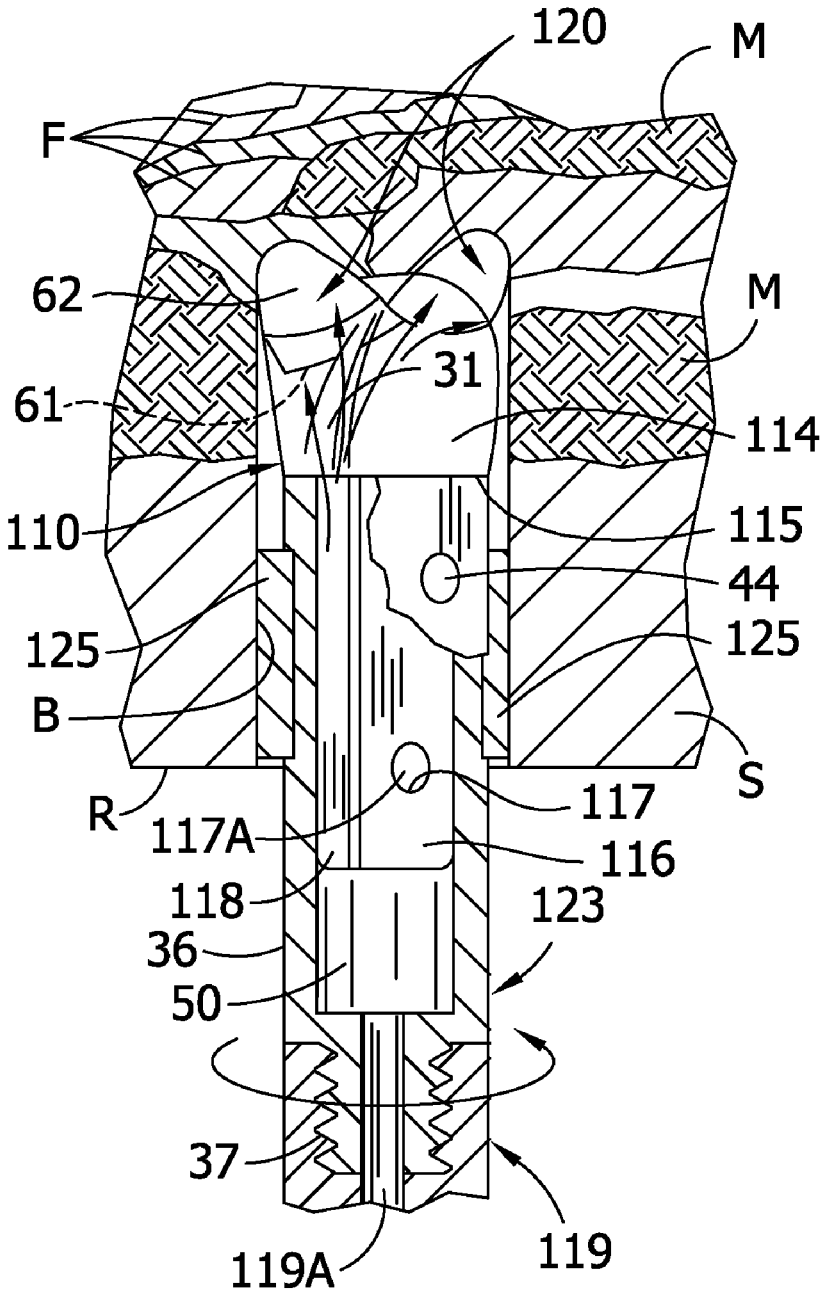
FIG. 2 PRIOR ART
FIG. 2 is a side elevational view, partly broken away, illustrating a second prior art rotary drill bit and a bit coupler.

FIG. 2 shows one embodiment of my earlier coring roof drill bit as taught by my U.S. Pat. No. 5,535,839, the disclosure of which is incorporated by reference. This coring-type drill bit 110 is shown connected through a bit coupler or mounting adapter 123 to a drive steel 119 and operates to drill bore B in the roof R as in a mine or tunnel. The roof top formation in FIG. 2 is lined to illustrate solid rock S, fractured rock or shale F and mud seams M. The drill bit 110 has a steel head mass 114 for seating and supporting superhard surfaced cutter inserts 120, and the bit body has a mounting shank 116 that is removably secured to the drive column 119 of a drilling machine. The drill bit 110 could be connected directly to the drive steel 119 (as in FIG. 1) for co-rotational movement together, but a mounting adapter or coupler 123 is preferred. Thus, the steel body mass 114 has an annular shoulder 115 adapted to seat against the upper surface 28 of the adapter 123, and the shank portion 116 of this drill bit is also provided with the usual vertical water flutes or flumes 118 recessed inwardly on opposite sides of the shank and which serve to channel flushing fluids for cooling the cutter inserts 120 and cleaning debris away from the cutting area of the tool. The shank 116 of drill bit 110 has cross-bores 117 between opposed flat outer surfaces of the shank to receive fastening pins or bolts 117A.

Figure 3:
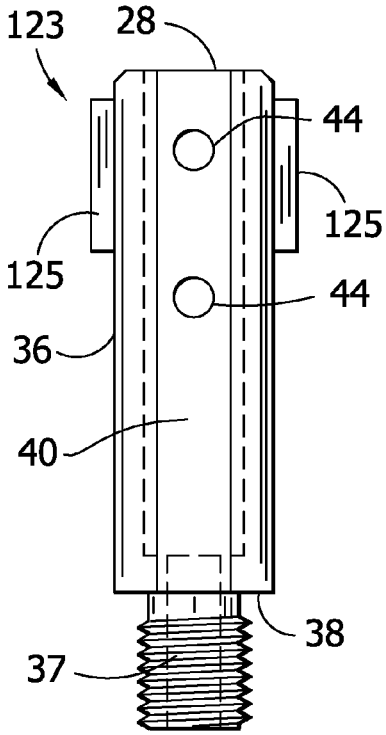
FIG. 3 PRIOR ART
FIG. 3 is a side elevational view of the bit coupler per se.
Figure 4:
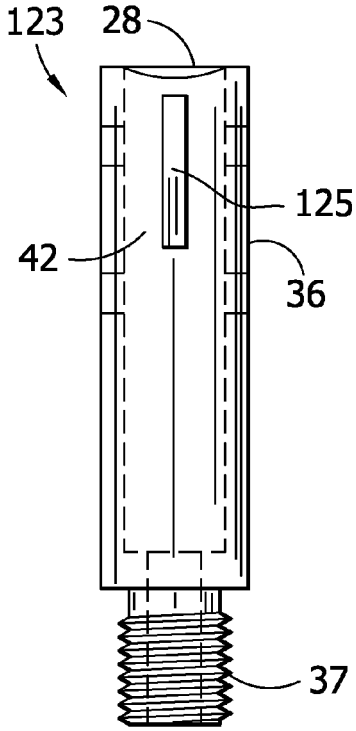
FIG. 4 PRIOR ART
FIG. 4 is a similar view of the coupler as rotated 90° from FIG. 3.

The bit coupler or mounting adapter 123, FIGS. 3 and 4, may be used with either tool 20, 120 and has an elongate body 36 with a threaded stub 37 on its lower end 38 for removable threaded connection to the upper end of the drive steel 19, 119. The outer body wall of the coupler 123 has opposed flat surfaces 40 for wrench engagement and arcuate surfaces 42 substantially complementary to the drive steel outer wall. Cross bores 44 are formed in flat walls 40 to match the cross-bores 17, 117 in the drill bit shank 116 and receive the fastening pins therethrough. The coupler 123 permits assembly and disassembly for replacing the drill bit 110 on the drive steel 19/119 with minimum downtime. An important function of the coupler 123 is to accommodate the flow of flushing fluid from the through-bore (119A) of the drive steel to the head mass 14, 114 and cutter inserts 20, 120. To that end the coupler 123 has a central body chamber 50 constructed and arranged to receive the drill bit shank 16, 116 with a sliding fit of the flat opposed shank walls to prevent relative rotation, and the vertical flow of flushing fluid upwardly through the coupler 123 is enhanced by providing vertical water flumes or canals 55 opposite to the shank water flutes 18, 118.

The coring-type drill bit 110 of FIG. 2 has at least two cutter inserts 120, each having a bullet-shaped carbide body with a cylindrical base 61 and an integral radially domed head 62 provided with a superabrasive PCD surfacing material. The PCD inserts 120 are angularly seated in sockets in the head mass 114 so that the axis of each insert is pitched forwardly and outwardly at preselected rake and skew angles relative to the direction of rotation so that the cutter inserts 120 are constructed and arranged on the head mass 114 to cut a predetermined bore gauge size. An important feature of the bit coupler 123 is the provision of bore reamer means 125 constructed and arranged to follow after the cutter inserts (20, 120) to maintain the bore gauge and compensate for rifling (i.e. cutting an undersized or grooved hole). The reamer elements 125 are preferably arranged in pairs on opposite outer sides of the bit coupler body 123 to extend from the upper end 28 in an axially extending longitudinal direction, and it will be understood that three or more reamer elements may be utilized. Clearly, the reamer elements 123 project radially outwardly from the bit coupler side wall and have reamer edges at a preselected bore-hole gauge relative to the gauge-margins "b" of the drill bit 10, 110.

In operation, the earth boring bit will be assembled on the drilling machine and be rotationally driven into the ground, wall or roof structure and the resulting cuttings should be flushed outwardly by the drilling fluids to clean the bore-hole B. The reamer/bit seat coupler 123 follows into the bore-hole and acts as a secondary drill bit to assure a smoother bore wall. Thus, the reamer/bit seat is especially valuable in roof bolting operations to assure that the hole for roof bolts is relatively smooth and clean so that installation of resin and roof bolts is facilitated.

As defined, hard/soft rock designates earthen formations that include solid hard rock sections HR having a high compressive strength in the range of 25,000 to 50,000 psi, and may include interspersed strata of fractured rock or shale F and mud seams M. Such earthen formations have heretofore been extremely difficult to drill into with prior state of the art drill bits. It is desirable to drill roof bore holes BH as quickly as possible to achieve optimum work production, and to that end optimum drilling parameters of thrust and drilling speeds are mandated. However, the density or compressive strength of any type of earth formation, which includes ores, hard/soft rock, coal, shale, mud, etc. may call for different drilling parameters and even different drill bit construction or configuration, as seen with reference to the prior art tools of FIGS. 1 and 2. Thus, the HCD tool of FIG. 1 performed well in drilling a solid earth formation such as coal or soft rock, but was known to fracture in drilling into earth formations having mixed strata of rock, mud, shale or other broken ground materials. The FIG. 2 prior art was designed to perform better in these varying earth formations and achieved excellent long-life productions when operated at lower drilling parameters.

It has been determined that the fracturing or breakage of drilling tools is attributable to two primary causes; (1) drill bit design that has inadequate strength to withstand the resisting compressive strength of the earthen material under design drilling loads of thrust and rotating speed; and (2) the presence of mixed earthen strata. Drilling tools systems in the past are conventionally made with drill steel and drill bit bodies made with 4140 high carbon steel. The 4140 grade of steel has a tensile strength of about 148,000 psi and a yield strength of about 98,500 psi. 4140 steel is known in the industry to have a high carbon content and little or no nickel or chromium. Furthermore, the prior art drill tools have been limited to smaller bore hole diameter sizes ranging up to about 1⅛ inch and these tools connect by ½ inch shanks to the drive steel. These prior drills have been operated at drilling parameters to bore into the primary earthen formations of the metal/non-metal mine, such as coal. However, if the drill bit breaks through this primary strata into a softer rock or mud mass, the drilling machine cannot rapidly reduce the speed to adjust for torque and the high carbon 4140 steel body and/or drive steel may be torsionally broken or fractured. The prior art tools have been successful in various mining roof bolting operations where the earth formations have been less dense (i.e. softer) and when drilling into substantially uniform strata, and such tools have been economical due to their out-performance of the old tungsten carbide drill bits that preceded. Never-the-less, the need for better drilling tools and methods is manifest even though the answer has not been apparent prior to extensive testing.

The essence of the present roof drilling invention resides, in part, in the more rugged design of the drill bit inserts, but also in providing a wider range of larger size bits that have a high fatigue-resistant and high alloy steel body coupled to reamer/coupler means and are operative to rapidly drill an increased linear length of bore holes at faster drilling speeds in hard/soft rock formations including hard rock strata of the greatest density.

Figure 5:
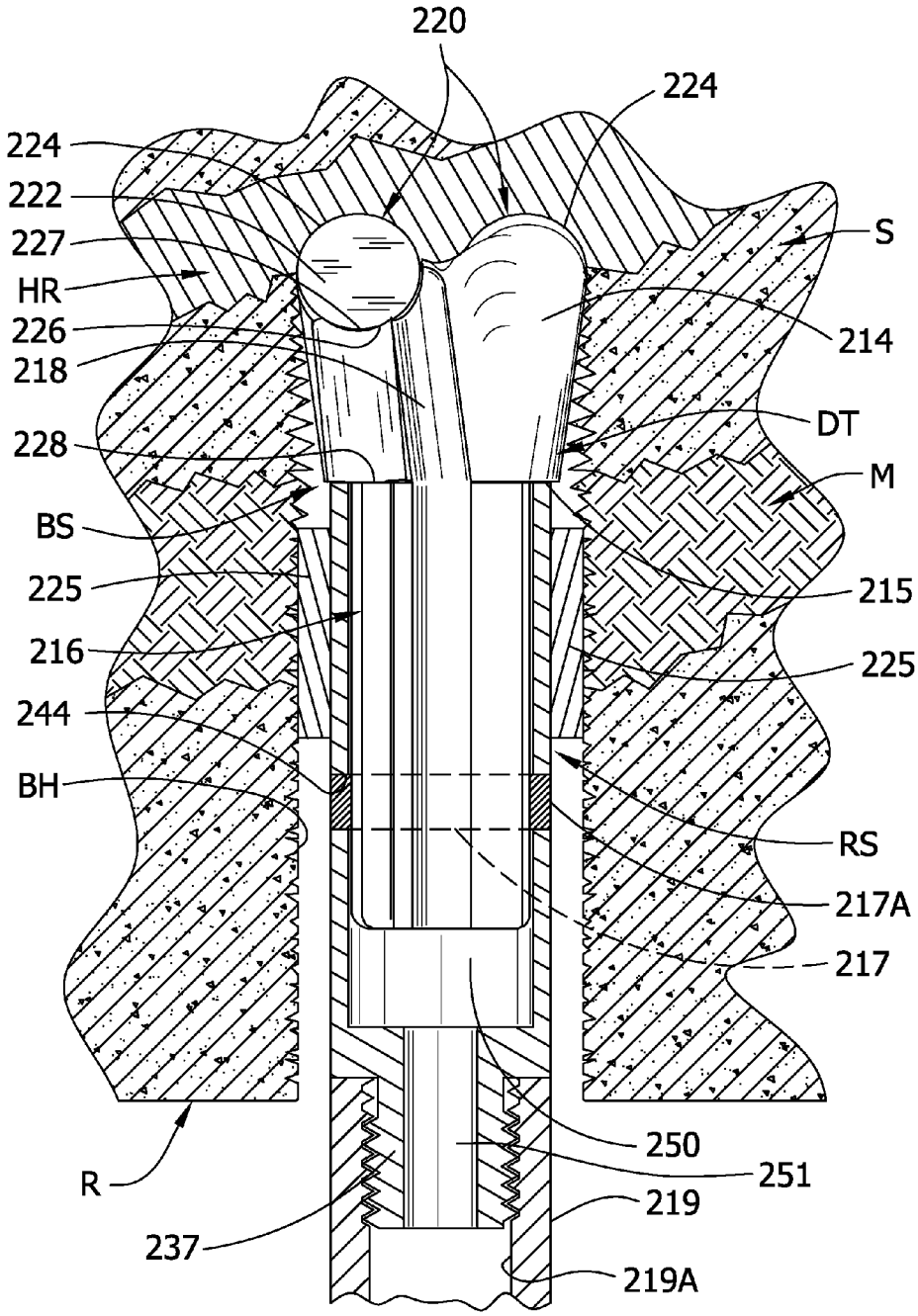
FIG. 5 is a side elevational view, partly broken away, of one preferred embodiment of a roof drill bit and reamer/coupler embodying the invention.
Figure 6:
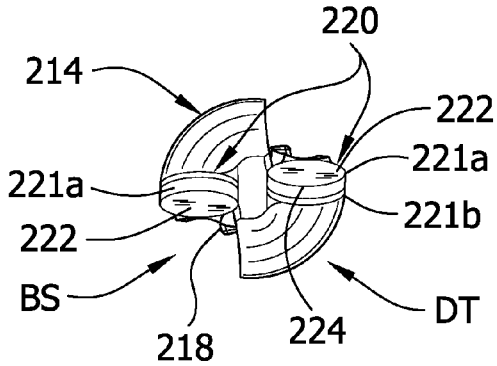
FIG. 6 is a top plan view of the drill bit of FIG. 5.
Figure 7:
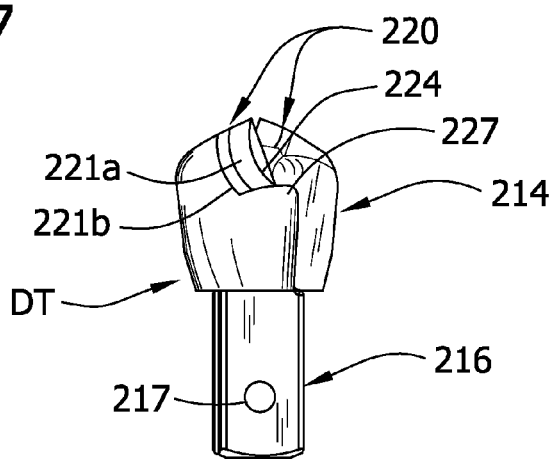
FIG. 7 is a side elevational view of the drill bit as rotated 90° from FIG. 5.
Figure 8:
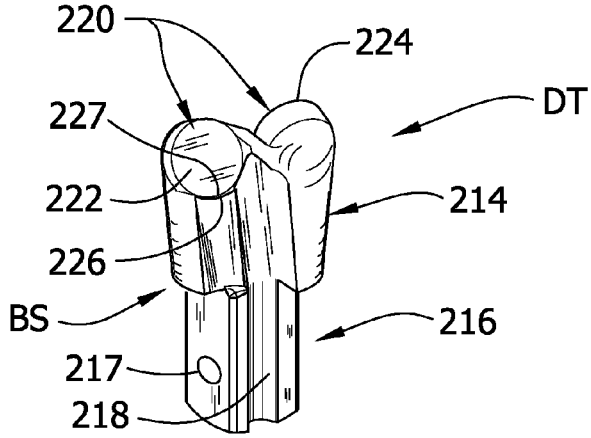
FIG. 8 is a perspective view of the FIG. 5 drill bit embodiment.

Referring now to FIGS. 5-8, the drilling tool system DT comprises one preferred embodiment of the present invention and is shown in an operative drilling position forming bore hole BH in a mixed rock/shale/mud formation above the roof R of a metal/non-metal mine, tunnel or the like. The hard rock strata HR typically may have compressive strength in the upper range of 25,000 to 50,000 psi. Also, as shown in FIG. 5, the hard rock strata HR may have other earth strata or seams above it such as mud M, shale or fractured rock F. FIG. 5 is representative of other metal/non-metal mine formations that could include a primary coal or ore boundary at the roof R, and other earth formations above it. It will be understood that this invention is useful to meet all types of roof bolting needs where a multitude of bolt holes of about 3 to 25 feet in depth may be required to form the prescribed supporting matrix of roof support required for safety in metal/non-metal mines, tunnels, etc.

The drilling tool system DT of the invention includes a drill bit body section BS with a head portion 214 and a shank portion 216 connected to a reamer/coupler section RS that couples the drilling tool system to the end of a tubular drive steel column 219. The head portion 214 has a pair of PCD cutter inserts 220 comprising full circle discs with a PCD layer 221*a* increased in thickness from about 0.030 to a thickness in the range of 0.045 to 0.065 inches, preferably about 0.060, and also having a significant increase in the thickness of the underlying tungsten carbide (WC) support table to produce an improved insert wafer increased in thickness from 0.250 inches to a thickness of 0.290 inches to thereby obviate compression fracturing. These wafers 220 with PCD layers 221*a* bonded to a tungsten carbide substrate 221*b* are constructed and arranged on the steel body head portion 214 in a typical way, as by brazing. Also, as typical of my prior PCD tools, the PCD wafers have wear faces 222 mounted to face in the direction of rotation and preferably are angularly mounted at a preselected negative rake angle of −5° to −30°, preferably −20°; and a negative skew angle of zero to −10°, preferably about −2° to −8° to thereby produce optimum slicing action into the hard/soft rock formation during drilling. The cutter inserts 220 are positioned in slightly spaced relation at the axial center of the drill bit to thereby form a coring/non-coring bit and achieve a larger diameter bore hole BH for the size of PCD wafers used. The size of bore holes formed by tools of the present invention can be larger than heretofore—in the range of about 1⅜ inch to 2.25 inches although some features of the invention may render the smaller 1 1/16 to 1¼ inch boring tool an acceptable substitute in some hard/soft rock drilling. It should be noted that these larger sized PCD wafers have a diameter of at least ⅝ inch and in the range of ⅝ inch to 1.0 inch, the larger circumference providing a cutting edge 224 with a wider and more efficient curvature. The lower side margin 226 of each wafer 220 is seated against a complementary shoulder 227 on the steel body to thereby form an opposing resistance to the compressive drilling forces exerted against these cutting insert wafers at the cutting edges 222.

The shank portion 216 of the drill bit section is enlarged from ½ inch to about ⅝ inch, as a preferred change of about 25% within the generally acceptable range of 9/16 to ¾ inches. This larger ⅝ inch shank 216 has a substantially square cross-sectional configuration and is referred to as a "heavy duty square shank" or "square shank tool" for reference. The shank 216 has external water flutes 218 on opposite sides for channeling flushing fluids from the drive steel 219 for cooling and cleaning debris from the cutter inserts 220. The shank 216 is cross-bored at 217 to be cross-pinned to the reamer/coupler R5 and form a unitary drilling and reaming system, as will be described.

An important feature is the use of a high fatigue-resistant steel to form the drill bit body 214, including shank 216 and the reamer/coupler RS—and even the drilling drive steel 219. Such high fatigue-resistant steel will be more expensive, but testing has now established that superior performance of the present drilling system will more than justify the expense. The high fatigue-resistant steel should have a tensile strength in the range of 175,000 to 225,000 psi and a yield strength in the range of 135,000 to 145,000 psi. For instance a preferred high nickel/chromium (NiCr) steel identified as 4340 steel that is heat treated to about Rc 40-45 and has a tensile strength of about 210,000 psi and a yield strength of about 141,000 psi. In actual testing, the drilling system of the invention showed an improvement performance 18.3 times better than prior PCD tools and is 1873 times better than carbide tools in drilling hard sandstone.

Referring particularly to FIG. 5, the reamer/coupler RS is similar to the reamer 123 shown in FIGS. 3 and 4. The reamer/coupler RS has an elongate cylindrical body 236 with a threaded male stub 237 on its lower end for threaded connection to the upper end of the drive steel 219. The annular end 228 of the reamer seats against the shoulder 215 formed by the shank 216 with the upper body portion 214 of the drill bit, and the reamer has one cross-bore 244 aligned with the cross-bore 217 of the shank 216 to receive pin 217A. The central chamber 250 of the reamer/coupler R5 is in fluid communication through port 251 with the through-bore 219A of the drive steel 219 and with the vertical water flutes 218 along the sides of the shank 216 and bit body 214 (see FIG. 8). The essence of the reamer/coupler R5 in the present invention is the provision of boring reamer means 225 to follow in tandem behind the PCD cutting inserts 220 as an under-reamer to compensate for rifling. The reamer means 225 are shown to be axially-extending rectangular insert members preferably made of tungsten carbide or other hard abrasive non-PCD material, although PCD reamer insert members could be employed. These insert members could also be different configurations as long as a substantial vertically-extending reaming dimension is provided. Typically such reamer means will be provided on opposite sides of the reamer body 236.

As indicated, a feature of the invention is to construct the reamer/coupler RS using the same high fatigue-resistant, high alloy steel as used for the drill bit body 214, 216. The high nickel/chromium 4340 steel previously described is substantially stronger than prior high carbon steels, such as 4140 steel, and permits the use of thinner reamer casings or bodies without sacrificing strength. This provides a larger central chamber 250 to accommodate the larger square shank 216 of the invention.

The roof drill tool DT and method of the present invention are designed to drill thousands of feet of bore holes BH in hard/soft rock formations having hard rock strata with a density in the range of 25,000 to 50,000 psi and withstand high thrust forces as well as torsion stresses as when drilling in broken earth formations. A typical New Fletcher roof bolting machine has a thrust pressure of about 5000 pounds or 1550 psi gauge setting, and drilling systems of the invention can operate at maximum thrust pressures and high and rotational speeds to achieve the highest production performance without failure. In the past the PCD tools could only work at 3500 pounds or 1100 psi gauge settings—and could still be expected to fail in hard rock environments.

In operation, therefore, the square shank drilling tool DT is secured to the reamer/coupler RS with the shank 216 nested within the central cavity 250 and being cross-pinned together by bolt 217A or the like which permit disassembly in case of excessive wear upon and need for replacement of the reamer section RS.

This drilling system is then assembled on the end of the drive steel 219 for drilling. Roof bolt holes are generally formed by engagement of the cutter inserts 220 against the face of the roof R at the designated bolt hole location. Vertical drilling upwardly into the rock of the roof structure takes place under the maximum design drill speeds and thrust pressures possible, which in the past has generally been at about three-fourths of the machine potential, i.e. about 3750 pounds. The present drill system permits drilling operations at maximum thrust of 5000 pounds. At such speeds there is still a potential for rifling in the bore hole BH. This is illustrated in FIG. 5 by the jagged bore hole walls formed by the wobble of the PCD drilling inserts while cutting the bore hole. Although not excessive it is considered highly desirable to employ the under-reamer RS as a secondary cutter to smooth away the jagged rifling edges and present a smoother bore wall for applying the epoxy plug and matrix anchoring bolts (not shown). It should also be noted that the "wobble" or rifling effect of the drill tool during a boring operation is advantageous in that the sideways wobble at the center of the tool causes the PCD wafers to cut into the core area and break out any core material to make the tool non-coring.

Figure 9:
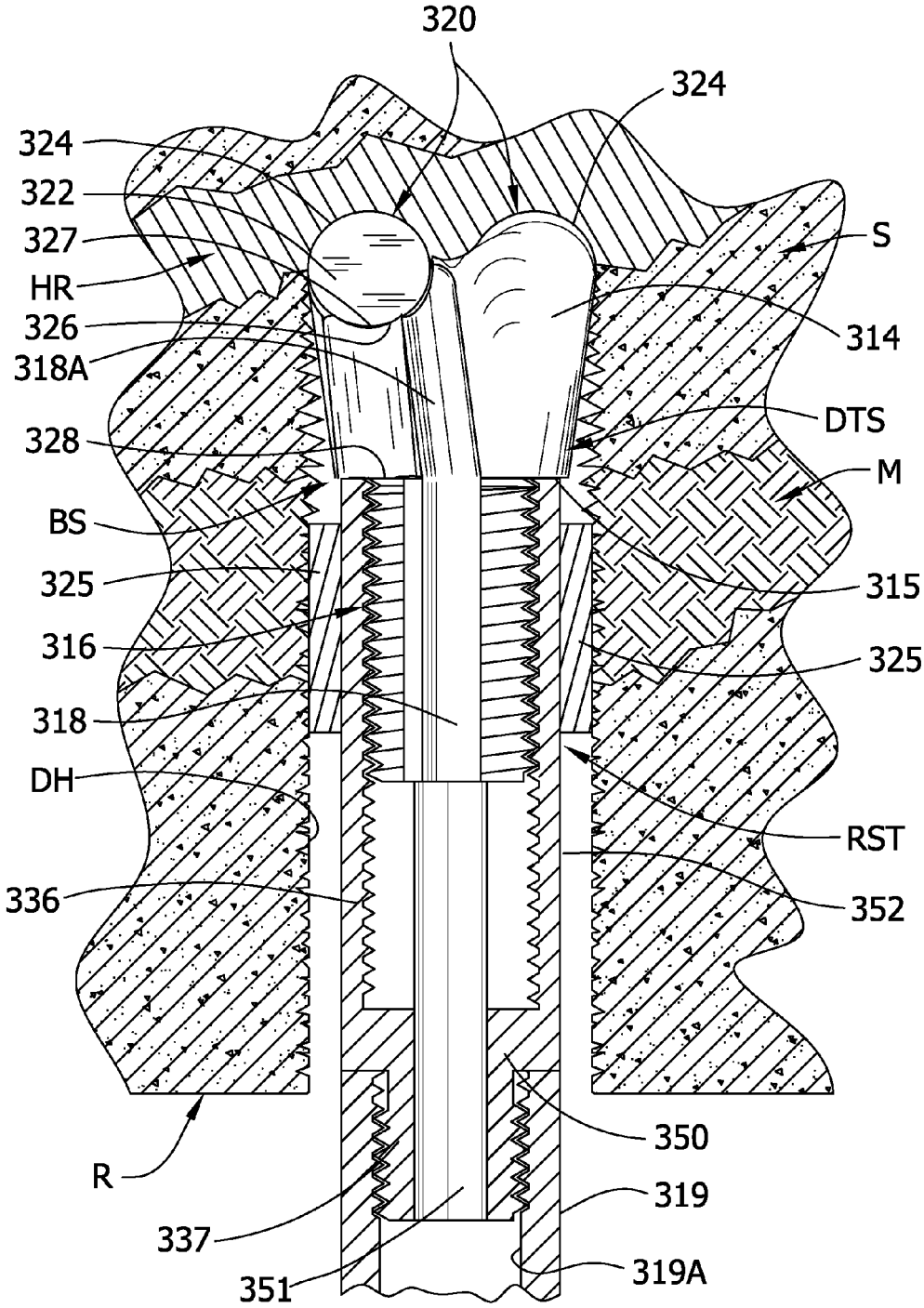
FIG. 9 is a side elevational view, partly broken away, of another preferred embodiment of a roof drill bit and reamer/coupler embodying the invention.
Figure 10:
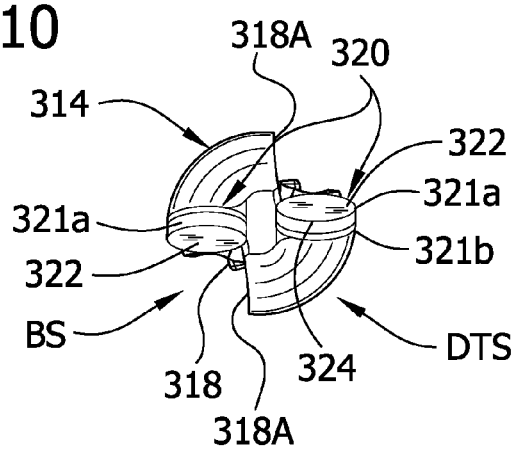
FIG. 10 is a top plan view of the drill bit embodiment of FIG. 9.
Figure 11:
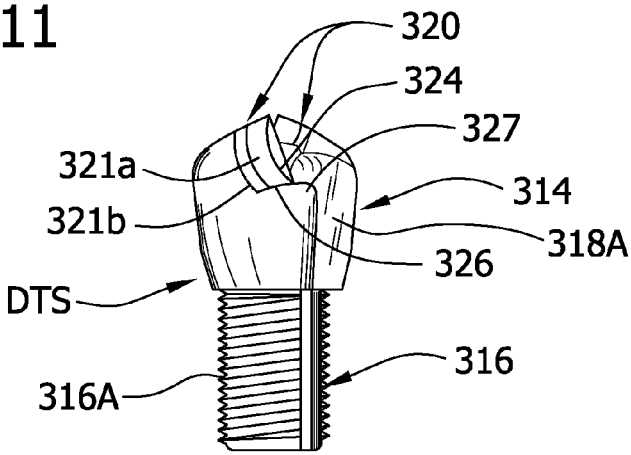
FIG. 11 is a side elevational view of the drill bit of FIG. 9, as rotated 90° from the FIG. 9 view.
Figure 12:
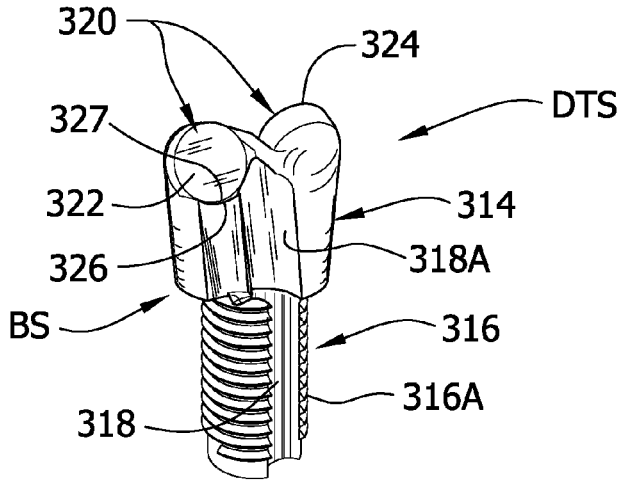
FIG. 12 is a perspective view of the FIG. 9 drill bit embodiment.

Referring now to FIGS. 9-12, the drilling tool system DTS comprises another preferred embodiment of the invention and differs primarily from the first embodiment of FIGS. 5-8 in that the DTS tool has a threaded shank 316 instead of the square shank 216 of the DT tool. In FIG. 9 the drilling tool system DTS, which comprises the drill bit section BS with head portion 314 and shank portion 316 and a reamer/coupler section RST with body portion 336, is shown in an operative drilling position forming drill (bore) hole DH in a roof structure similar to that of FIG. 5 in a metal/non-metal mine, tunnel or the like as previously set forth.

In the FIG. 9 embodiment the drill bit section BS is substantially identical to the FIG. 5 embodiment, and has a pair of PCD cutter inserts 320 with full circle discs of at least ⅝ inch and having a PCD layer 321*a* increased in thickness in the range of about 0.045 to 0.065 inches, an increased thickness of at least 150% from about 0.030 inches and preferably to a thickness of about 0.060. The PCD layers are bonded to a substrate 321*b*, and typically being brazed to the steel body head 314. The PCD wafers 320 have wear faces 322 diametrically arranged on opposite sides of the tool to face in the direction of rotation and mounted at a predetermined negative rake angle in the range of −5° to −30°, and preferably about −20°. A negative skew angle in the range of zero to −10°, and preferably about −2° to −8° has been found to produce excellent slicing action into hard/soft rock or mineral (coal) formations during drilling.

The cutter inserts 320 are positioned in a slightly spaced relation at the axial center forming a coring/non-coring drilling or boring action and achieving a larger diameter bore hole BH with smaller sized PCD wafers. For instance, a multitude of larger bore holes in the range of 1⅜ inch to 2.25 inches can be achieved with PCD discs of ⅝ inch to 1 inch and at substantially higher speeds than could be achieved by the smaller 1⅛ inch drill bits of the prior art, as will become more apparent. The lower margin 326 of the wafers 320 are seated on complementary shoulders 327 of the steel body to oppose the compressive drilling forces exerted on these PCD wafers 320. It will also be noted again that the larger wafers, up to 1.0 inch, have a wider and more efficient circumferential cutting curvature.

The shank portion 316 of the drill bit Section BS is enlarged from ½ inch to about ⅝ inch, a preferred increase of about 25% within the acceptable range of 9/16 to ¾ inch. The shank portion 316 preferably has an exterior 16 mm thread 316A and is called a "heavy duty threaded shank" or "threaded shank" for reference. The threaded shank 316 has external vertical water flutes 318 on opposite sides for channeling flushing fluids from the drive steel for cooling and cleaning the cutter inserts 320. The upper part of the head portion 314 has a canted or pitched channel portion 318A that extends the vertical threaded shank flutes 318 to channel cooling fluid angularly to flow outwardly across the faces 322 of the wafers 320.

Referring to FIG. 9, the reamer/coupler RST is similar to the reamer/coupler RS of FIG. 5. The reamer RST has an elongate body 336 with a threaded male stub 337 on its lower end for threaded connection with the drive steel 319. When assembled the annular upper end 328 of the reamer/coupler seats against the shoulder 315 formed by the shank 316 with the upper body portion 314 of the drill bit. The reamer/coupler RST has a threaded interior chamber 350 to securely receive the threaded shank 316 of the drill bit, and this chamber 350 is in fluid communication through port 351 in the stub 337 with the bore 319A of the drive steel 319 to deliver flushing fluids to the water flutes 318, 318A. The reamer/coupler RST is provided with reamer means 325 to work behind the drill bit PCD inserts 320 and smooth the bore-hole DH as in the case of the FIG. 5 embodiment, a preferred form of the reamer means 325 are at least two insert members secured in spaced relation with each other to project radially outwardly from the outer wall 352 near the upper end 315 of the reamer. It is important these abrasive non-PCD inserts 325 have a substantial vertically-extending dimension to provide an extended reaming life.

As previously indicated, an important feature of the invention is the use of high fatigue-resistant steel to form the drill bit body 314 and shank 316, and also the reamer/coupler RST (and drive steel 319). A presently preferred high fatigue-resistant steel is a high nickle/chromium (NiCr) steel known in the trade as 4340 steel that is heat treated to about Rc 40-45 and has a tensile strength of about 200,000 psi and a yield strength of about 141,000 psi. Thus high fatigue-resistant steels useful in the present invention have a substantially superior strength than the conventional drill tool steels, such as 4140, that have been used heretofore. In actual testing, the drilling system of the present invention greatly outperforms conventional systems in all aspects including speed of drilling, drilling capability in harder rock and/or mixed earthen formations, and long lasting life (extended linear drilling footage) and with less tool wear and failure. The present roof drill bit system and method are designed to drill thousands of feet of bore holes in hard/soft rock formations with strata having densities up to 50,000 psi and withstand high thrust forces as well as torsion stress as when drilling in broken earth formations. Roof bolting machines can now be operated to achieve their maximum potential and achieve maximum drilling performance without drill tool failure whereas in the past PCD tools could only be worked at about 1500 pounds or 1100 psi gauge settings—and still fail in hard rock environments.

In operation, the threaded shank drilling tool system DTS with drill bit and reamer/coupler, in assembled condition on a boring machine drive steel 319, is sequentially driven upwardly into the ceiling structure above roof R at predetermined multitudinous locations to bore and ream bore holes. Drilling takes place under maximum drill speeds and thrust pressures, which heretofore has been at about three-fourths of the machine potential; i.e. about 3750 pounds. Thus the present invention permits bore hole drilling in hard/soft rock at thrust forces up to about 5000 pounds, and the reamer RST compensates for rifling caused by any drill bit wobble of the PCD inserts to provide a smoother bore wall for application of the epoxy—anchor bolt matrix in metal/non-metal mining. As previously indicated, the "wobble" creating rifling is also a factor in making the drill tool coring/non-coring in that the slightly spaced PCD wafers 320 at the tool axis will move laterally during drilling to break out any core that might develop. Thus, smaller PCD wafers can be mounted in spaced relation at the axis of the drill bit head (in a coring-type design) and yet achieve a larger and clean diameter drill hole (in non-coring performance).

The present heavy duty drill bit tool has further applications in the mining and construction field. Should it be necessary or desirable to drill bore holes of a size significantly larger than 2.0 inches in diameter (i.e. from 2.25 to 4.0 inches), those skilled in the art will recognize that the drill bit section (DT of FIGS. 6-8 or DTS of FIGS. 10-12) can be utilized as a pilot bit in a drilling system employing secondary over-reamer cutters of the type shown in my U.S. design Pat. Nos. D483,042; D483,382 and D487,753, the disclosures of which are incorporated herein by reference. The application of the drill bit section of the invention to an over-reamer system provides efficient drilling of larger diameter bore holes in hard/soft rock structures with extended tool life.

From the foregoing it will be seen that substantial advances have been made by the present drilling system and method in the field of roof bolting matrix in metal/non-metal mining.

When introducing elements of the present invention or the preferred embodiments(s) thereof, the articles "a", "an", "the" and "said" are intended to mean that there are one or more of the elements. The Terms "comprising", "including" and "having" are intended to be inclusive and mean that there may be additional elements other than the listed elements.

It is now apparent that the objects and advantages of the present invention over the prior art have been fully met. Changes and modifications of the disclosed forms and methods of the invention will become apparent to those skilled in the metal/non-metal mining field and related arts, and the invention is only limited to the scope of the appended claims.

What is claimed is:

1. A heavy duty drill tool for performing a sequential series of roof boring operations for a roof bolting matrix in metal/non-metal mines, comprising:

a drill bit section having a high fatigue-resistant steel body constructed and arranged with PCD cutter inserts for forming a bore hole diameter up to about 2¼ inches, said PCD cutter inserts being disc-shaped wafers and having a thickness up to about 0.290 inches, and said steel body including a heavy duty shank constructed for connecting the drill bit section, said shank having a connecting dimension in the range of 9/16 to ¾ inch; and a reamer section having a high fatigue-resistant steel body constructed and arranged with a cutting insert and being secured to the heavy duty shank to thereby form a coupler means for connecting the drill bit section to a drilling apparatus set at optimum drilling parameters for hard/soft rock formations.

2. The heavy duty drill tool of claim 1, in which said high fatigue-resistant steel body of at least one of said drill bit section and said reamer section is formed of a high nickel/chromium alloy characterized by a tensile strength in the range of 175,000 to 225,000 psi and a yield strength in the range of 135,000 to 145,000 psi.

3. The heavy duty drill tool of claim 1, in which the steel bodies of both said drill bit section and said reamer section are formed of 4340 steel having a tensile strength of about 210,000 psi and a yield strength of about 141,000 psi.

4. The heavy duty drill tool of claim 1, in combination with a drilling drive steel member to which the reamer section is removably connected, and said drive steel member being formed of high fatigue-resistant steel comprised of a high NiCr alloy.

5. The heavy duty drill tool of claim 1, in which said drill bit section is a pilot bit constructed and arranged to drill a pilot bore in the range of 1⅜ to 2¼ inches, and said reamer section being constructed with plural cutting inserts arranged to form over-reamer means for forming a larger bore hole greater than 2¼ inches.

6. The heavy duty drill tool of claim 1, in which the disc-shaped wafers have a thickness range of about 0.250 to 0.290 inches.

7. The heavy duty drill tool of claim 1, in which the disc-shaped wafers have a PCD layer in the thickness range of about 0.045 to 0.065 inches.

8. The heavy duty drill tool of claim 1, in which said PCD cutter inserts have front wear surfaces facing in the direction of rotation, and have arcuate upper cutting edges and arcuate lower margins, said steel body being formed with arcuate support ledges complementary to the lower margins of the PCD cutter inserts to seat and support the PCD cutter inserts against maximum compressive drilling forces exerted against the upper cutting edges.

9. The heavy duty drill tool of claim 8, including means for delivering flushing fluid across the wear surfaces of said PCD cutter inserts comprising a vertically-oriented flute formed along the outside side of the shank and an angularly related channel in the side of the drill bit head portion in fluid communication with the flute and being angled toward a front wear surface.

10. The heavy duty drill tool of claim 9, in which the heavy duty shank of said drill bit section has a square shank configuration with a dimension in the range of 9/16 to ¾ inch, and said means for delivering flushing fluid comprising external vertical water flutes along the heavy duty square shank and angled channels directed toward the PCD wear surfaces.

11. The heavy duty drill tool of claim 10, in which the reamer section body has a chamber to receive the square shank of the drill bit section therein, and pinning means securing the drill bit section and reamer section together to form a unified tandem hole boring unit.

12. The heavy duty drill tool of claim 9, in which the heavy duty shank of the drill bit section is externally threaded and has a dimension in the range of 9/16 to ¾ inches, and said means for delivering flushing fluid comprises external vertical water flutes along opposite sides of said heavy duty threaded shank and angled channels directed toward the PCD wear surfaces.

13. The heavy duty drill tool of claim 12, in which the reamer section body has a chamber to receive the threaded shank of the drill bit section therein and threadedly securing the drill bit section and reamer section together to form a unified tandem hole boring unit.

14. The method of drilling a sequential series of roof boring operations for forming a roof bolting matrix in metal/non-metal mines, comprising:

forming a heavy duty drill tool having a drill bit section made of a high fatigue-resistant steel body with PCD cutter members constructed and arranged for forming bore hole diameters up to 2¼ inches, and said steel body including a heavy duty shank constructed for connecting the drill bit section;

forming a reamer section having a high fatigue-resistant steel body with an inner chamber constructed and arranged for securing the heavy duty shank therein to thereby form coupler means connecting the drill bit section to a drilling apparatus, providing at least one abrasive cutting insert on the reamer section body;

said high fatigue-resistant steel body of at least one of said drill bit section and said reamer section being formed of a high nickel/chromium alloy characterized by a tensile strength in the range of 175,500 to 225,000 psi and a yield strength in the range of 135,000 to 145,000 psi; and setting optimum drilling parameters for operating the drill bit section and reamer section in tandem in hard/soft rock formations.

15. The method of claim 14, in which said high fatigue-resistant steel body of the drill bit section is tempered to a Rockwell of 40 to 45 to have a tensile strength in a preferred range of 209,500 to 211,000 psi.

16. The method of claim 14, in which the steel bodies of both said drill bit section and said reamer section are formed of 4340 steel having a tensile strength of about 210,000 psi and a yield strength of about 141,000 psi.

17. The method of claim 14, including using said PCD cutter members to form a bore hole in the range of 1⅜ to 2¼ inches, and sizing said heavy duty shank to have a reamer section connecting dimension in range of 9/16 to ¾ inches.

18. A method for greatly extended bore hole drilling in hard/soft rock formations as in metal/non-metal mines for establishing a roof bolting reinforcement matrix, comprising the steps of:

1. setting rotational drilling parameters that call for thrust forces up to 5000 pounds;

2. providing a heavy duty drilling system that includes a. a drill bit section having a main steel body formed from a high nickel/chromium alloy steel having a tensile strength in the range of 175,000 to 225,000 psi, and being constructed and arranged with PCD cutting members having PCD surface layers with a thickness in the range of 0.045 to 0.065 inches and tungsten carbide support layers therefore whereby to form said PCD members having an increased mass, and the PCD layers having outer cutting edges arranged to bore a hole with a diameter of between 1⅜ inch and 2¼ inches; and b. a reamer section having a main steel body formed from a high nickel/chromium alloy steel having a tensile strength in the range of 175,000 to 225,000 psi, and having at least two radially outwardly projecting non-PCD abrasion inserts defining thereacross a predetermined rock boring under-reamer diameter smaller than the bore hole diameter across the outer cutting edges of said PCD cutting members; and c. said drill bit section and reamer section having axially aligned coupling means comprising a heavy duty shank formed on the steel body of the drill bit section and a complementary shank-receiving chamber in the steel body of the reamer section; and 3. axially interfitting the drill bit and reamer sections in a telescoped relationship to form a unitary cutting and reaming system and mounting the system on a drilling apparatus operating at thrust forces up to 6000 pounds to sequentially drill a multitude of bore holes.

19. The method of claim 18 in which the heavy duty shank and shank-receiving chamber have a threaded connection in their telescoped relationship.

20. The method of claim 18 in which the heavy duty shank has a square shank configuration received in the reamer section chamber and being secured therein.

* * * * *